US007501566B2

(12) United States Patent
Glazer

(10) Patent No.: US 7,501,566 B2
(45) Date of Patent: Mar. 10, 2009

(54) BRASS-WIND INSTRUMENT VALVE AND METHOD

(76) Inventor: Benoit Glazer, 14507 Timucua Ct., Orlando, FL (US) 32837-7110

( * ) Notice: Subject to any disclaimer, the term of this patent is extended or adjusted under 35 U.S.C. 154(b) by 400 days.

(21) Appl. No.: 10/706,186

(22) Filed: Nov. 12, 2003

(65) Prior Publication Data

US 2005/0098020 A1 May 12, 2005

(51) Int. Cl.
*G10D 7/10* (2006.01)

(52) U.S. Cl. ..... 84/388

(58) Field of Classification Search ..... 84/388–394
See application file for complete search history.

(56) References Cited

U.S. PATENT DOCUMENTS 3,030,846 A * 4/1962 Greenleaf ..... 84/388
3,835,748 A * 9/1974 Olson ..... 84/388
6,008,444 A * 12/1999 Chesko et al. ..... 84/388

FOREIGN PATENT DOCUMENTS

JP 2004354492 * 12/2004 ..... 84/388

* cited by examiner

*Primary Examiner*—Kimberly R Lockett
(74) *Attorney, Agent, or Firm*—Akerman Senterfitt

(57) ABSTRACT

A brass wind instrument and method comprising: a single piece body further comprising a plurality of valve cylinders for receiving valves and a plurality of ports and interfaces in fluid communication with said valve cylinder, wherein said ports and interfaces are substantially perpendicular to the axis of said valve cylinder.

18 Claims, 10 Drawing Sheets

BRASS-WIND INSTRUMENT VALVE AND METHOD

FIELD OF THE INVENTION

The subject invention pertains to brass-wind musical instruments and more specifically to mono body valve blocks for brass-wind instruments.

BACKGROUND OF THE INVENTION

In brass-wind musical instruments, sounds are initially produced by players pressing their lips against bell-shaped mouthpieces and blowing into the mouthpieces while maintaining their lips in a rigid configuration. The air passing through the rigid lips of the players causes the skin of the lip to resonate thereby resulting in a concentric column of air comprising a "buzzing" sound. As this column of buzzing air passes into the instrument, it flows through a series of tubes and valves comprising the instrument wherein it is amplified before it exits from the bell portion of the instrument thereby creating a tone. It is the series of sharp turns within the valves and tubes that generally alter the consistency of the density of the air column and have a negative effect to the tone and the intonation.

The negative effects resulting from the numerous deficiencies in current brass-wind instruments have been necessary evils due to the currently widely accepted designs. While minor changes have been proposed to improve brass-wind instruments, musicians have had little choice but to "live with" and play music with the current designs.

To alter the tones emanating from the instrument, players will adjust the rigidity of their lips, press a series of valves and/or adjust any of the tuning pipes in the instrument. Adjusting the rigidity of the lips alters the initial pitch of the column of air prior to its entering the instrument. Depressing the valves can operate to elongate the column of air resonating through the instrument thus resulting in differing notes. Adjusting any of the tuning pipes operates to fine-tune the instrument by combining the proper pitch with the proper valve configuration and the proper tuning; players are able to play specific notes and thus music.

Current brass-wind instruments are generally adequate for producing the desired music; however, there is always room to improve the quality of sound produced. Most of the drawbacks to current brass-wind instrument sounds find their genesis in undesirable inconsistencies of the density within the concentric column of air flowing through the instrument. These inconsistencies in the column of air can originate from a number of causes.

Brass-wind instruments such as, for example, the trumpet, comprises valve sections consisting of valves in separate valve chambers. These valve chambers are generally connected to one another by way of soldered or brazed brass tubes. There are at least three defects inherent in this design that causes impedance in the flow of the column of air traveling through the instrument leading to an interruption of the positive vortex, thereby resulting in an imperfect sound.

First, due to the distance between the valve chambers, there is a size restriction on the valve. With this size restriction, pistons have restricted air channels caused by two air channels occupying the same general area in the piston valve. Because any connection of the air channels in the valve would effectively rend the instrument useless, one of the valves must have impedance. As a result, one of the conflicting air channels is required to have a shape comprising impedance. This impedance generally comprises a bubble shape located in the air channel. Such impedance in the air channel operates to disrupt the positive vortices of the column of air thus negatively altering its sound.

Another defect that causes a disruption of the column of air comes as a result of the method of connecting the valve chambers to each other, as well as the remainder of the instrument. Where two tubes are connected, often a sharp ridge or edge operates to disrupt the flow of the air column causing additional impedance in sound. Because tubes are soldered or braised, the connection resulting from the manufacture of the instrument is often less than perfect. This causes a negative effect on the positive vortices, thereby resulting in a diminished sound.

Additional defects inherent in the size of the valve section are the odd shapes and sharp bends of the tubes connecting the valve chambers to one another. As the column of air passes through the instrument, it is desirable to have a perfectly smooth transition throughout. Odd shapes and sharp bends can hinder the desired smooth transition and impede the sound. Sharp bends are not limited to the valve sections as there are many sharp bends in brass-wind instruments that can act to disrupt or impede the flow of the column of air created by the player. For example, the tuning tubes that operate to elongate the column of air often have sharp 180° bends that further impede the sound created by the player. With these defects in mind, there has long been a desire in the brass-wind instrument industry to improve the quality of sound.

Apparatus for tuning instruments in an attempt to overcome many sound deficiencies are known in the art. For example, U.S. Pat. No. 3,990,342 to Reeves discloses an adjustable piston valve having a mechanical means for continuous adjustment of the upstroke and down stroke of the valve. The adjustment means can be used to tune the instrument for improved play and sound.

U.S. Pat. No. 4,273,020 to Happe discloses a method of constructing a brass-wind instrument comprising a lead pipe having an increased taper. The gradually increased taper results in a more pure column of air thereby creating an improved sound.

U.S. Pat. Nos. 4,276,804 and 4,512,233, both to Holland disclose pitch adjusters attached in series with the tubes comprising the instrument. The pitch adjusters operate to change the length of the column of air to fine tune the instrument.

With all of these inventions furthering the state of the brass-wind instrument art, there is still a need to remedy the inherent defects in currently accepted designs that cause an impedance in sound due to the undesired changes and inconsistencies in the density of the air column. Accordingly, improvements to current brass-wind instruments are both desirable and possible. The following describes such improvements.

SUMMARY OF THE INVENTION

In view of the foregoing background, it is therefore an object of the present invention to provide a brass-wind instrument and method for making such having improved sound characteristics through a monobody valve block, unimpeded air channels, and larger radii throughout the instrument.

This and other objects, features, and advantages in accordance with the present invention are provided by a brass-wind instrument comprising a mouthpiece, a lead-pipe, a monobody valve block, a series of tubes connected to said monobody valve block provided to change the length of the air column in the instrument, valves disposed in said monobody valve block, an exit-pipe, and a bell. More specifically, the monobody valve block comprises a series of tubes and valves having sufficient size and shape to avoid impeding the travel of the air column therethrough.

The monobody valve block is comprised of a single solid piece of material having valve chambers milled therein. For example, the valve chambers are milled vertically through the material. All tube interfaces entering and exiting the valve block are milled at substantially right angles to the body of the valve block and perpendicular to the corresponding valve chamber. Each valve chamber has a guide means that operates to keep the valve disposed therein from rotating within the valve chamber during use.

The configuration of the monobody valve block is such that the size of the valves may be increased while the valve block size is substantially similar in overall size to that of conventional valve blocks that comprise separate valve chambers. The valve's pistons are of sufficient size to comprise air channels that do not compete for space. This provides for unoccluded air channels thus resulting in improved acoustical performance.

The top and/or bottom of each valve chamber may contain threaded regions. The top threaded region operates to maintain the position of the valve and keep it in its proper place. The bottom-threaded region can receive a cap having a shallow basin that operates to collect residual valve lubricant, or other undesirable materials.

The valve indexing can be substantially similar to that of conventional brass-wind instruments, such as, for example, trumpets, cornets, baritones, tubas and the like. Accordingly, the improved acoustical characteristics of the present invention may be employed in a brass-wind instrument without having to learn to play an additional instrument.

Attached to the monobody valve block is generally a first slide, a second slide, and a third slide in fluid communication with the valves to allow for a change in the length of the air column. The plurality of slides may be adjusted accordingly to further tune the instrument and further improve the acoustical characteristic thereof.

The radii of the bends in the brass-wind instrument of the present invention are enlarged to reduce the sharp bends associated with conventional instruments. The enlarged radii allow for the vortices in the air column to travel through the instrument with little to no impedance thus adding to the improved acoustical performance.

The mouthpiece receiver of the present invention can comprise, for example, a gapless mouthpiece receiver. The gapless mouthpiece receiver substantially eliminates negative vortices resulting from the "gap" that generally occurs between the shank of current mouthpieces and the mouthpiece receivers attached to the lead-pipes. In general, as the buzzing air column crosses the gap of conventional instruments negative vortices are created as a result of the turbulence that occurs. The mouthpiece of the present invention is comprised of a solid piece of material bored out to further comprise a negative conical shape having a diameter equal to that of the smaller end of the positively conical lead-pipe. The turbulence resulting from any existent gap can be controlled by modification of the mouthpiece shank and the air column undergoes no further constriction once it leaves the mouthpiece. Accordingly, the result is a positive concentric vortex having very little or no impedance.

Further objects and advantages of the present invention will become apparent by reference to the following detailed description of the invention and appended drawings wherein like reference numbers refer to the same feature, element, or component.

DETAILED DESCRIPTION OF THE INVENTION

Figure 1:
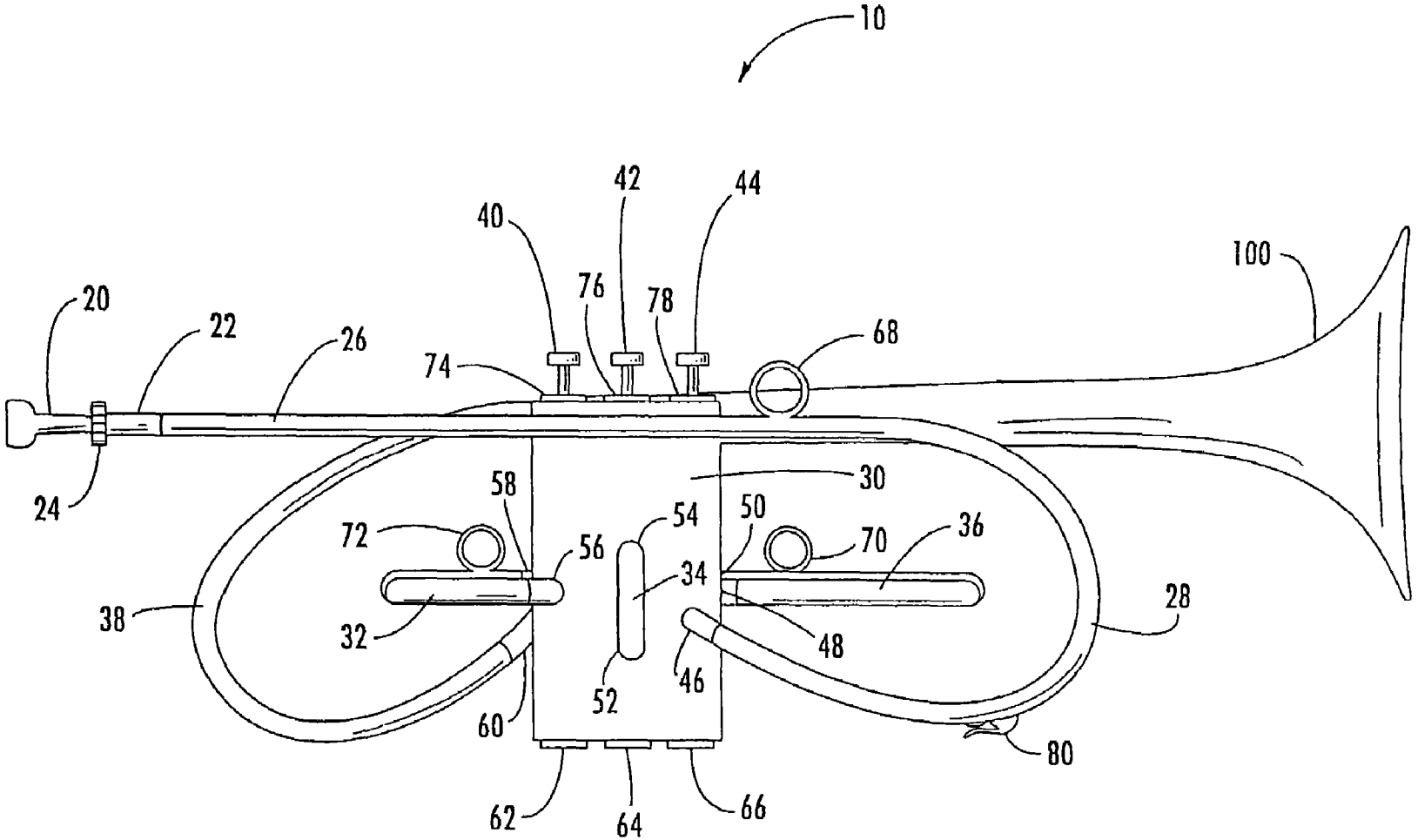
FIG. 1 is an elevational side plan view of a brass-wind musical instrument comprising a monobody valve block according to the present invention.
Figure 2:
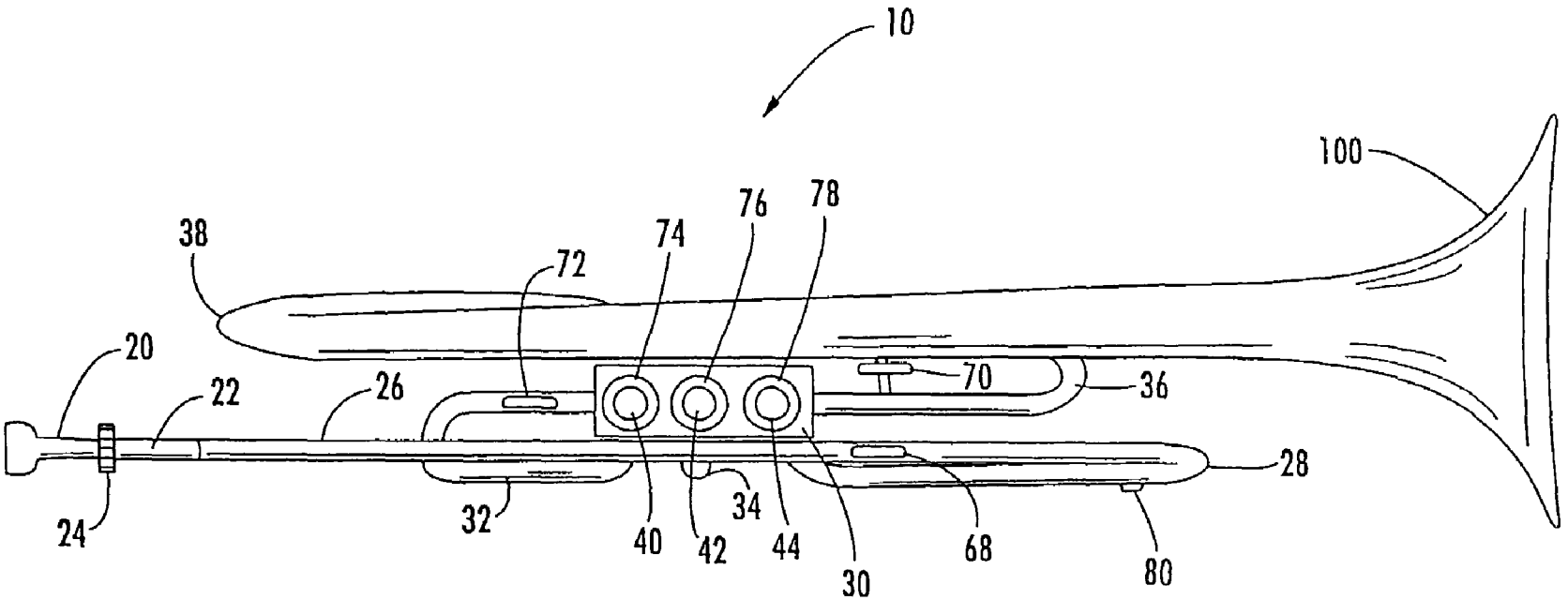
FIG. 2 is an elevational top plan view of a brass-wind musical instrument comprising a monobody valve black according to the present invention.

Referring now to FIGS. 1 and 2, a brass-wind apparatus comprising a monobody valve block according to the present invention is illustrated and generally referred to by the reference number 10.

The brass-wind instrument 10 generally includes a mouthpiece 20, a mouthpiece receiver 22, a lead-pipe 26, an entrance tube 28, monobody valve block 30, valves 40, 42, 44, a first-slide 32, a second-slide 34, a third-slide, 36 an exit tube, 38 and a bell 100.

Sound comprising a column of air is made at the mouthpiece 20 that is complementarily received in a mouthpiece receiver 22. The mouthpiece 20 preferably comprises a negative conical internal shape and is received in the mouthpiece receiver 22. The mouthpiece receiver 22 further comprises a friction means 24 to removably retain and adjust the mouthpiece 20 therein. The mouthpiece 20 may be adjusted to fine tune the instrument 10. The column of air is pushed from the mouthpiece 20 into the lead-pipe 26 and then into the entrance tube 28.

The entrance tube 28 may comprise a spring valve 80 at a low point on the entrance tube 28 to allow for the release of accumulated moisture or other material. The entrance tube 28 preferably comprises an arch with an enlarged radius to allow for minimal interruption of the air column. The entrance tube 28 is in fluid communication with the monobody valve block 30, preferably at the third valve chamber 94 through the lead-pipe interface 46.

The column of air can be subjected to elongation as it passes through the monobody valve block 30. Thus, tones are created and music can be played. This elongation is facilitated through a plurality of elongation tubes comprising slides 32, 34, 36. The monobody valve block 30 is in fluid communication with a first-slide 32, a second-slide 34, and a third-slide 36, each of which may be adjusted to tune the instrument and each of which are connected in fluid communication with the monobody valve block 30 to allow for the elongation of the column of air when corresponding valves 40, 42, 43, are depressed. The preferred valve indexing of the present invention is substantially similar to conventional brass-wind instrument indexing, except that it allows for a through-hole on the whole length of the monobody valve block, and it provides for all four sides of valves one and three to be used.

The first-slide 32 is in fluid communication with the first valve chamber 90 at a first first-slide interface 56 and a second first-slide interface 58. The second-slide is in fluid communication with the second valve chamber 92 at a first second-slide interface 52 and a second second-slide interface 54. The third-slide 36 is in fluid communication with the third valve chamber 94 at a first third-slide interface 48 and a second third-slide interface 50. Each interface 46, 48, 50, 52, 54, 56, 58, 60 in the monobody valve block is positioned in a location so as to substantially align with the appropriate air channels (not shown) in the corresponding piston valves 41, 43, 45 when the valves are fully depressed or not depressed at all. Each valve piston 41, 43, 45 can comprise a valve guide 51, 53, 55, respectively to maintain appropriate valve alignment.

When played, the column of air enters into the monobody valve block wherein it then passes through the valves and various elongation tubes. The column of air exits the monobody valve block 30 at the first valve chamber 90 wherein it enters the exit tube 38 at the exit tube interface 60. The air column travels through the exit tube 38 and out of the instrument 10 through the bell 100.

The instrument may further comprise finger holes 68, 70, 72 for maintaining a better grasp on the instrument during play.

Figure 3:
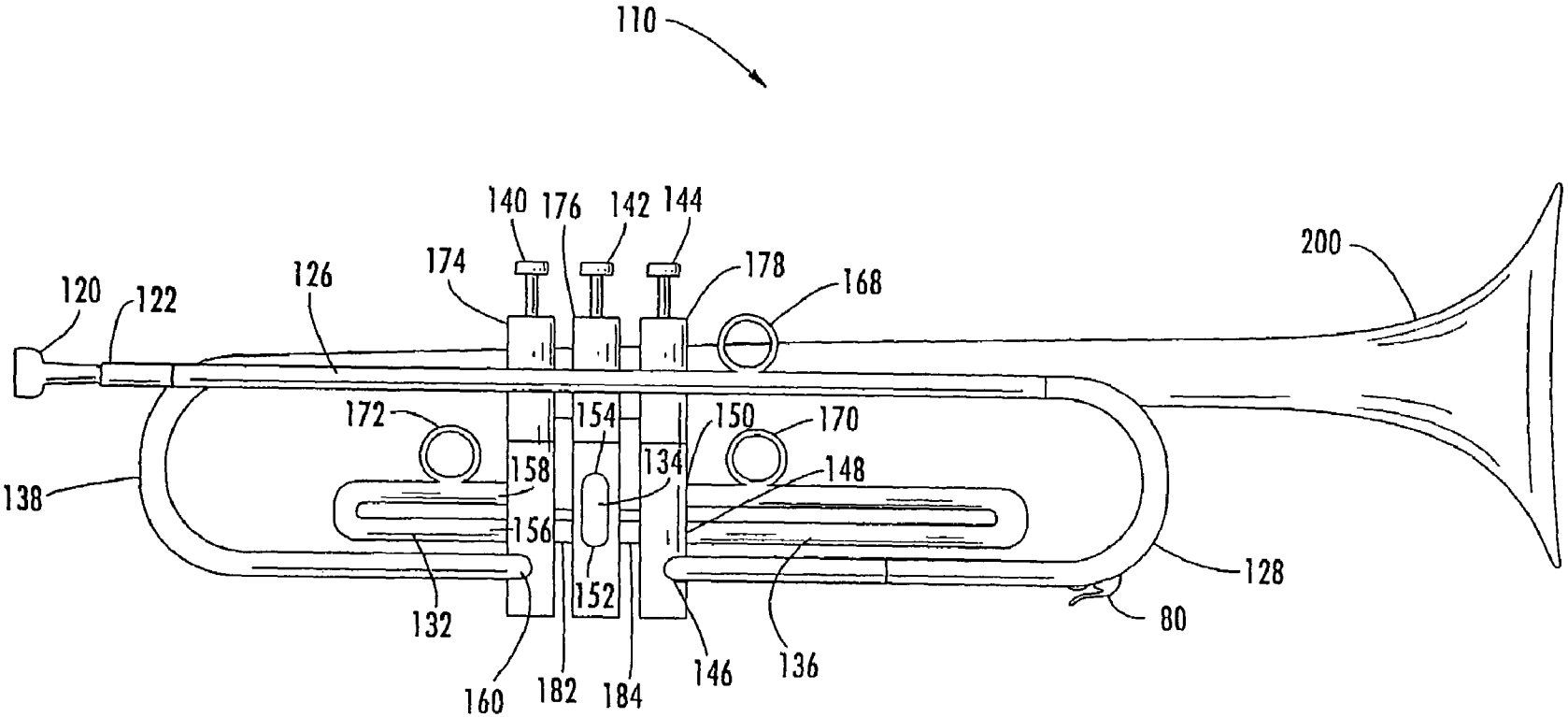
FIG. 3 is an elevational side plan view of a prior art trumpet.
Figure 4:
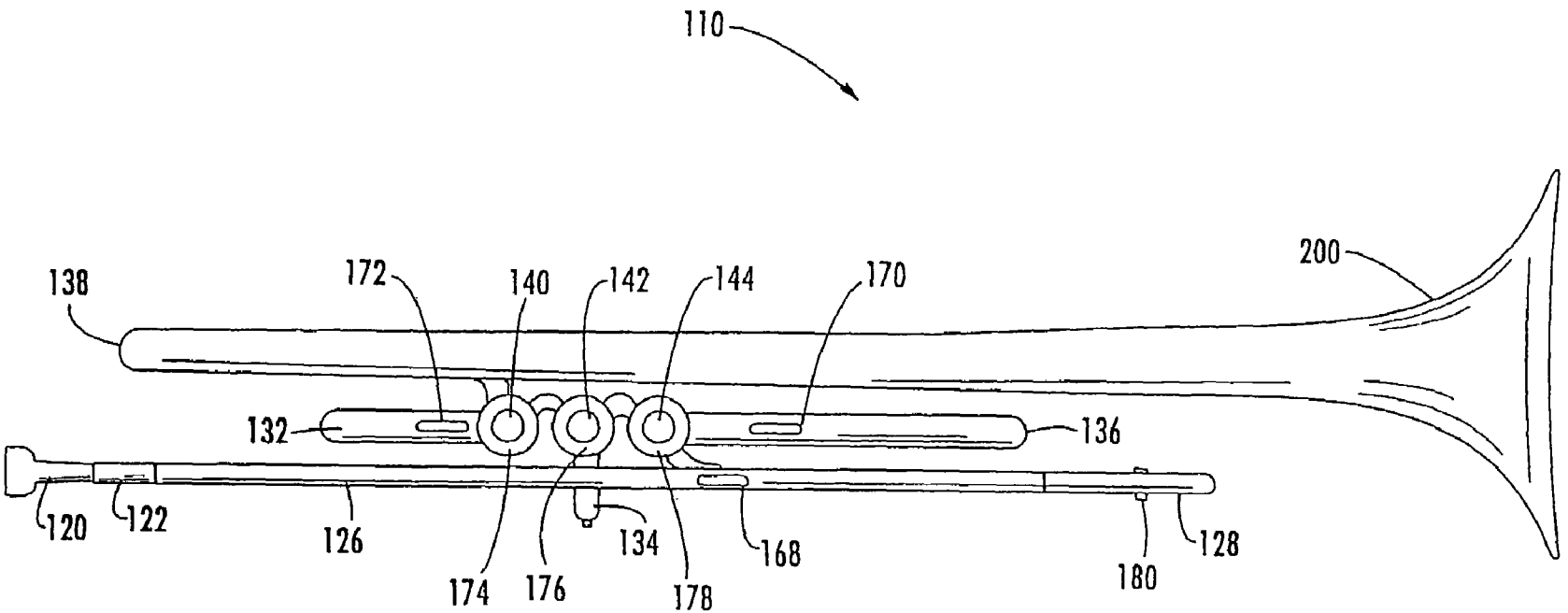
FIG. 4 is an elevational top plan view of a prior art trumpet.

Referring now to FIGS. 3 and 4, a prior art trumpet design is illustrated and generally referred to by the reference number 110.

As can be easily seen from a view of the prior art trumpet 110 the bends of the tubing comprising the instrument are substantially sharper than those of the present invention. For example, the bend in the entrance tube 128 is sharper than that of the present invention in all aspects including the entrance tube interface 146. The first slide 132, the second-slide 134 and the third-slide 136 all have a sharper bend than that of the instant invention. In addition, all have sharper bends at their respective interfaces 156 and 158, 152 and 154, and 148 and 150. Moreover, the exit interface 160 of the exit tube 138 has a shaper bend before the air column exits the instrument.

Figure 5:
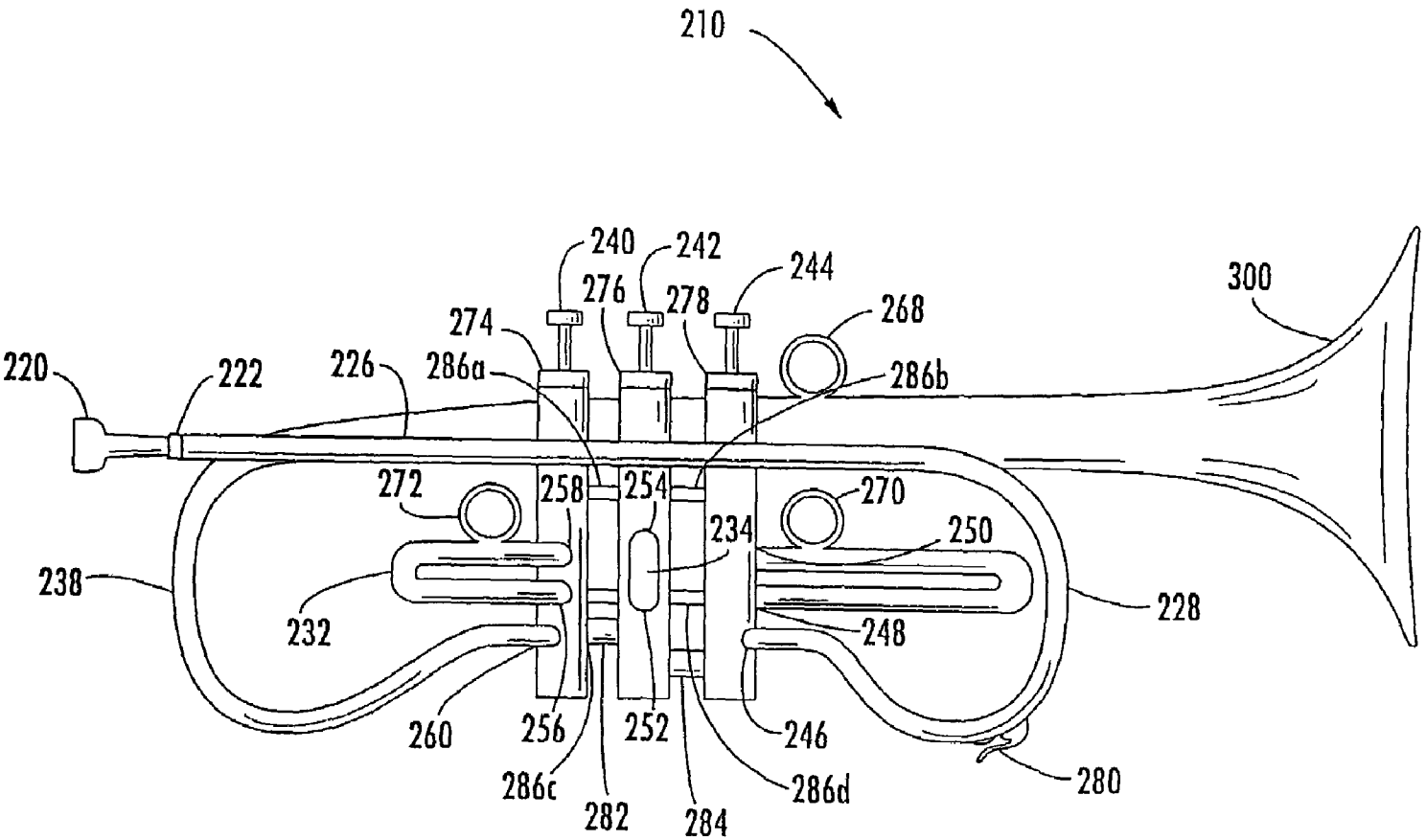
FIG. 5 is an elevational side plan view of a prior art cornet comprising a shepard's crook design.

Referring now to FIG. 5 a prior art cornet having a shepard's crook design is illustrated and generally designed by the reference numeral 210. The enlarged radii of the entrance tube 228 and exit tube 238 theoretically remedied a small portion of the defects inherent in conventional trumpet design. This design however did not achieve its intended purpose because although the entrance tube 228 and exit tube 238 had larger radii initially, each tube still had an abrupt and sharp bend prior to interfacing with the valve chamber. As can also be seen, the first-slide 232, the second-slide 234, and the third-slide 236 largely remained unchanged. Each slide has an acutely sharp bend resulting in an impedance in the air column. While some impedance occurred as a result of the tube structure comprising much of the prior art instruments 110 and 210, the lion's share of the impedance occurred as a result of the design of the prior art valve sections.

Figure 6:
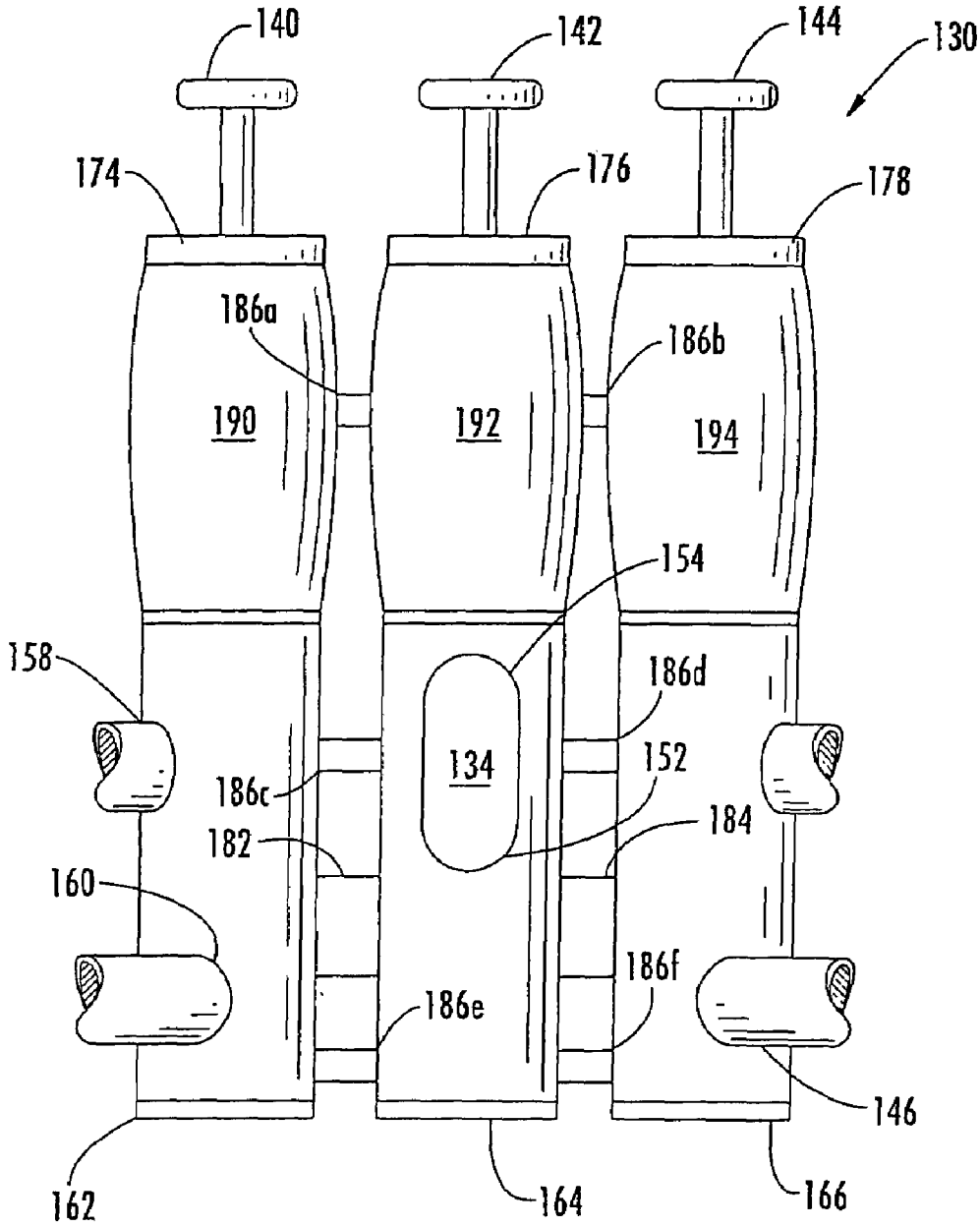
FIG. 6 is an elevational side plan view of a conventional prior art valve block.
Figure 7:
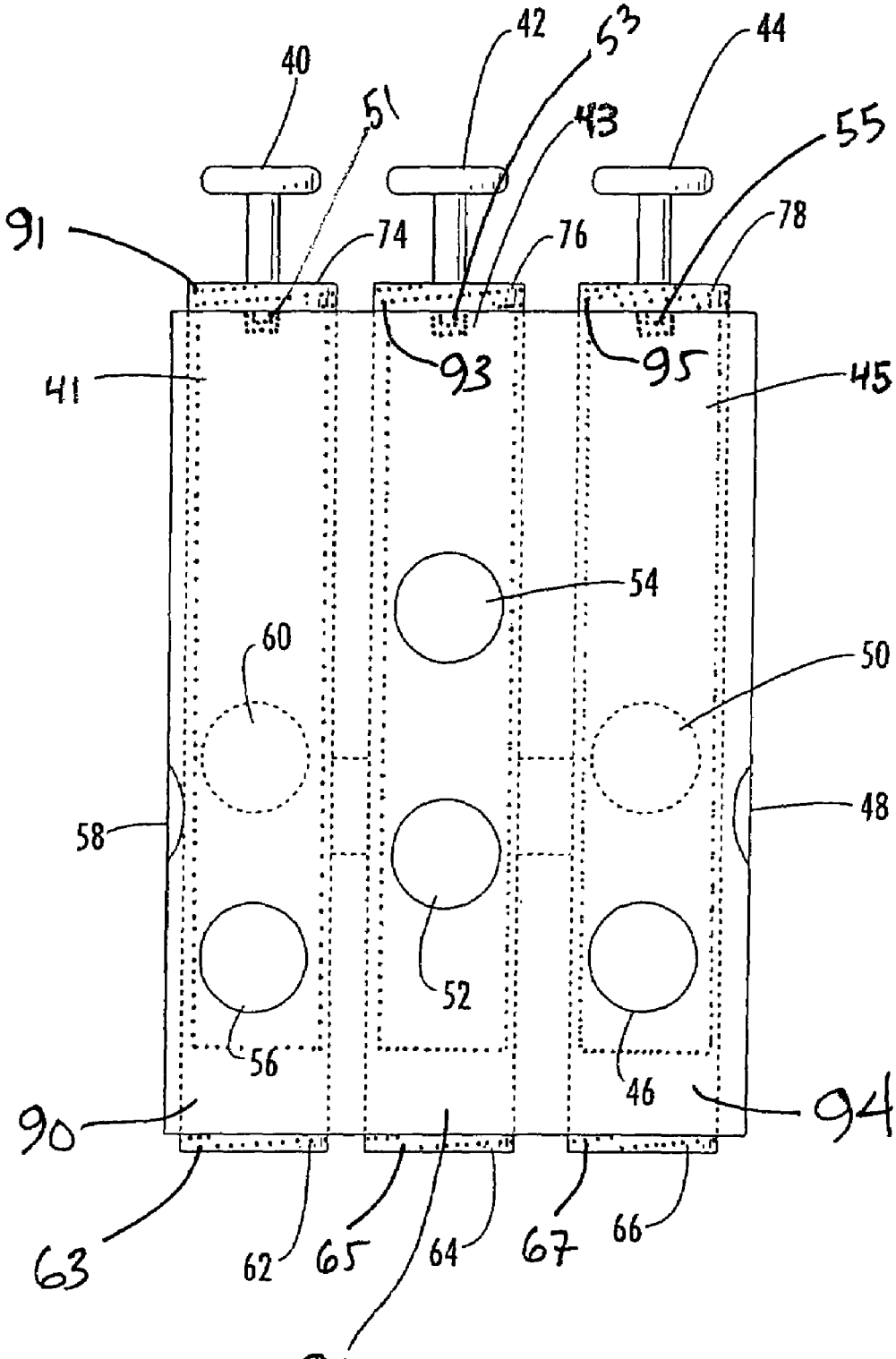
FIG. 7 is an elevational side sectional view of the monobody valve block according to the present invention.

Referring next to FIG. 6 a prior art valve casing is illustrated and generally designed by reference number 130. As is shown the first valve 190, second valve 192, and third valve 194 are separately constructed and attached by attachment means 186*a* through 186*f*. Also shown are the acutely sharp bends at the entrance to the interface 146, the second slide exit interface 152, the second slide 134, the second slide entrance interface, the first slide exit interface 160, the third valve second valve interface 184, and the second valve first valve interface 182. Not shown but present in the design are acutely sharp bends at the third slide entrance interface (not shown) and the exit tube interface (not shown). Also not shown, but present are the U air channels in the valve pistons 41, 43, 45 which cause further impedance of the air column. Turning next to FIG. 7, the monobody valve block 30 provides for a smoother transaction of the air column over the prior art. The monobody valve block comprises a series of valve cylinders 90, 92, 94 milled directly out of a solid piece of metal. Each interface 46, 48, 50, 52, 54, 56, 58, 60 is also milled directly into the monobody valve block at an angle substantially perpendicular to the respective valve cylinder 90, 92, 94. The valve pistons 41, 43, 45 are of sufficient size to comprise unoccluded air channels. The monobody valve block 30 may comprise a threaded regions at the top of the valve cylinders 91, 93, 95 as well as the bottom 63, 65, 67 to receive valve retention caps 74, 76, 78 and valve wells 62, 64, 66, respectively.

Figure 8:
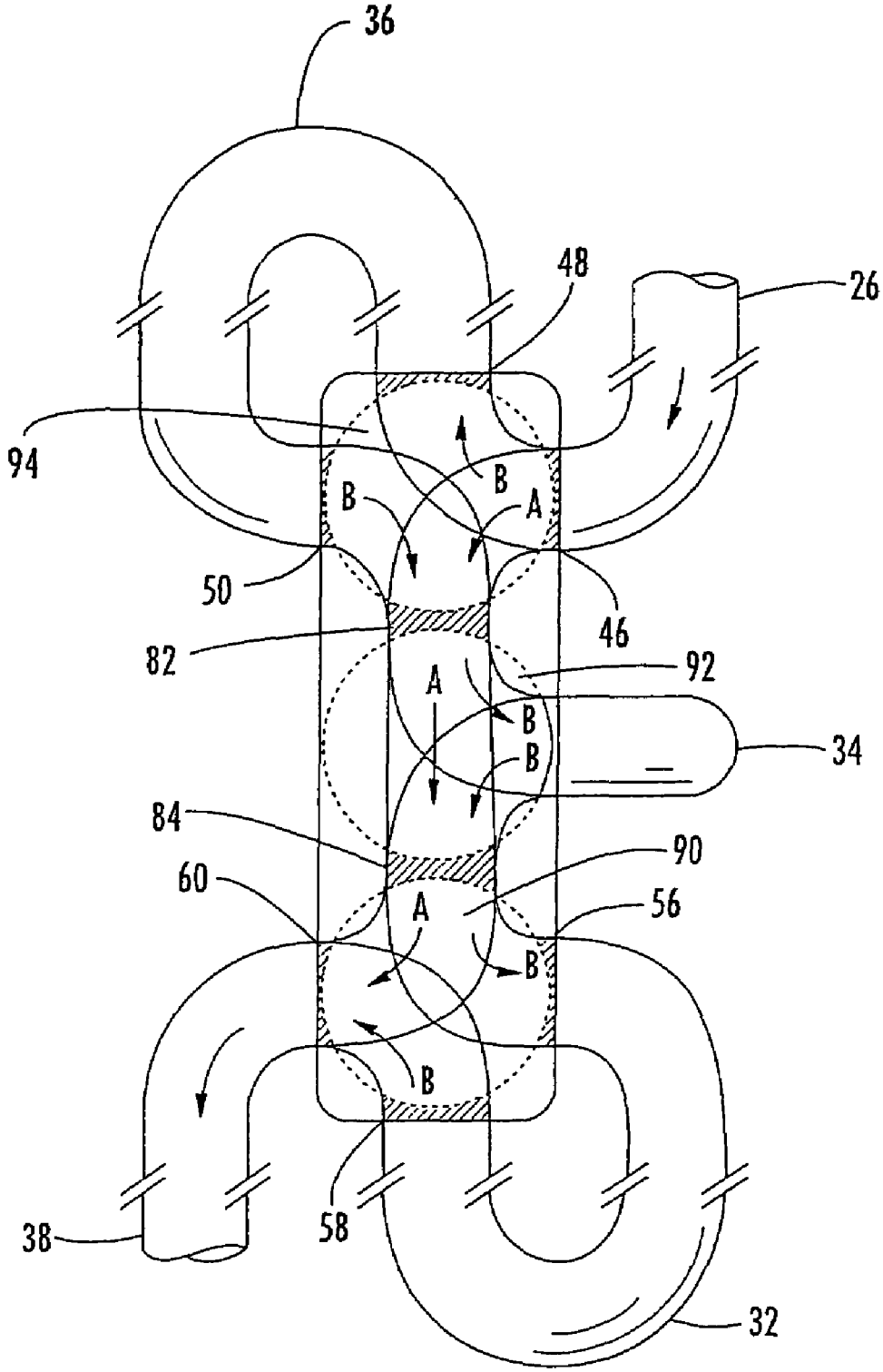
FIG. 8 is an elevational sectional top view illustrating the valve indexing of the monobody valve block according to the present invention.
Figure 9:
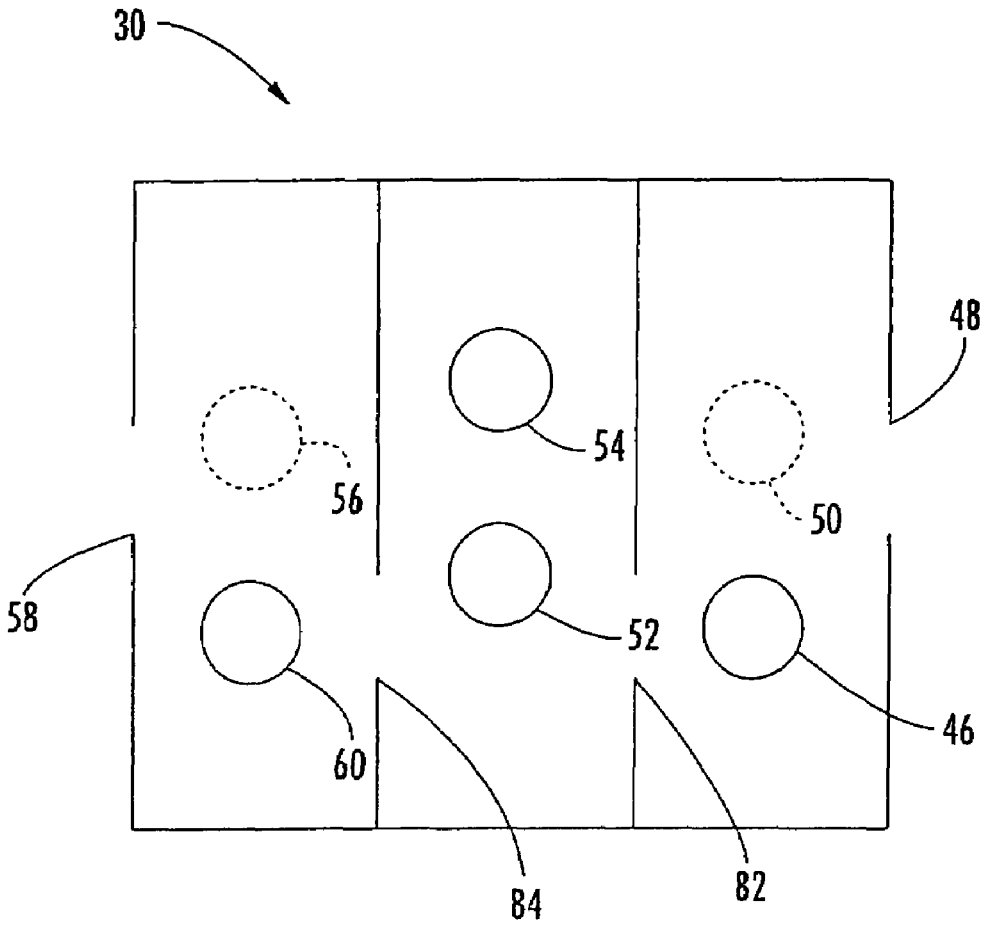
FIG. 9 is an elevational sectional side view illustrating the valve indexing of the monobody valve block according to the present invention.

Referring next to FIGS. 8 and 9, the valve indexing of monobody valve block 30 is illustrated. The arrows indicate the pathway that the column of air created by the player will follow through the instrument. The reference letter A indicates the path of the particular valve in an "at rest" position. The reference letter B indicates the path of a particular valve in the "depressed" position.

The column of air created by the player travels down the lead pipe 26 to the lead pipe interface 46 of the third valve 44. When the third valve 44 is in the rest position A, the column of air travels through the lead pipe interface 46 to the third valve-second valve interface 82A and into the second valve 42. When the third valve 44 is in the depressed position B, the air column travels through the lead pipe interface 46 through an air channel (not shown) in the third valve 44, out through the third-slide exit interface 48 through the third-slide 36, back into the third valve 44, through the third-slide entrance interface 50, through the valve 44, through the third valve-second valve interface 82B and into the second valve 42.

The column of air enters the second valve 42 at the third valve-second valve interface 82. When the second valve 42 is in the past position A, the column of air travels through the third valve-second valve interface 82, through an air channel (not shown) in the second valve 42, through the second valve first valve interface 82 and into the first valve 40.

When the second valve 42 is in the depressed position B, the air column travels through the third valve-second valve interface 82, through an angled air channel (not shown) in the second valve 42, through the second slide exit interface 52, through the second slide 34, through the second slide enhance interface 54, into another angled air channel (not shown) in the second valve 42 and into the second valve-first valve interface 84.

When the first valve 40 is in the rest position A, the column of air travels into an air channel (not shown) in the first valve 40 from the second valve-first valve interface 84 and exits the monobody valve block 30 through the exit tube interface 60, through the exit tube 38 and out through the bell 100.

When the first valve 40 is in the depressed position B, the air column travels through the second valve-first valve interface 84, through an angled air channel (not shown) in the first valve piston 40, through the first slide exit interface 56, through the first slide 32, through the first slide entrance interface 58, through another angled air channel(s) in the first valve piston 40, through the exit tube interface 60, through the exit tube 38 and out of the instrument 10 through the bell 100.

Figure 10:
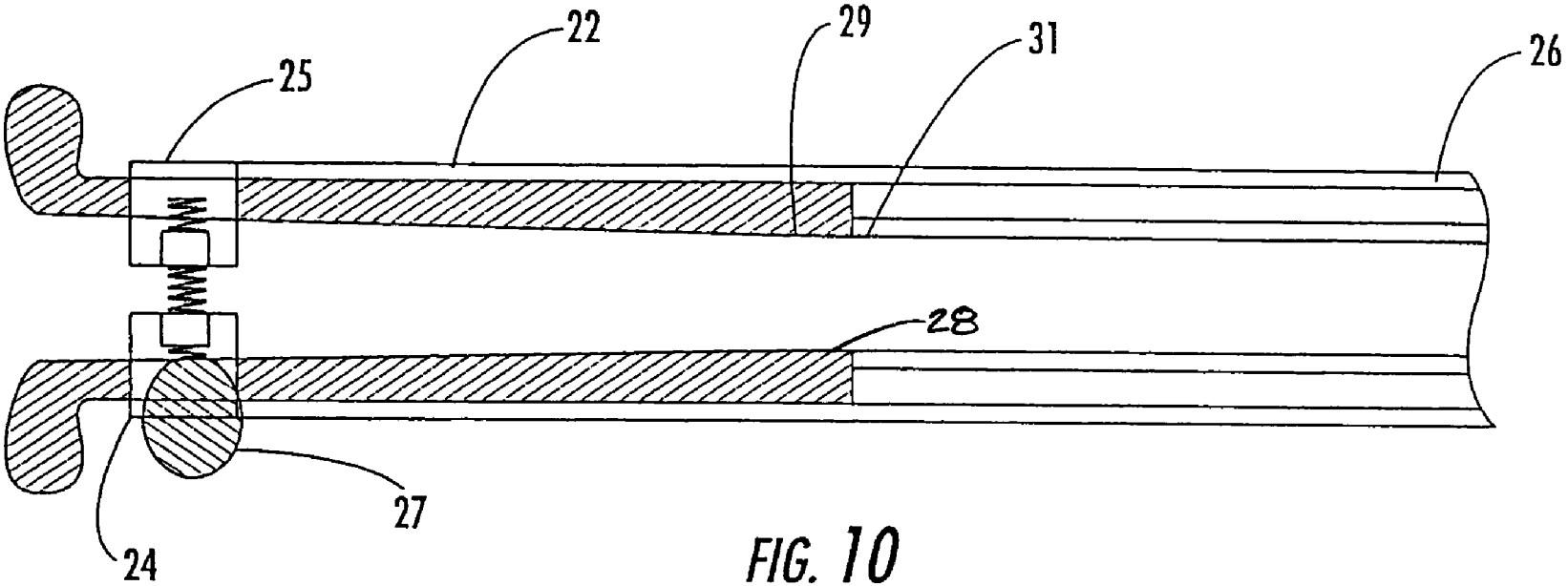
FIG. 10 is an elevational sectional side view of the gapless mouthpiece according to the present invention.

Referring finally to FIG. 10 the gapless mouthpiece assembly is illustrated. The mouthpiece 20 comprises a shank 29 having a negative conical interval shape and is generally milled from a solid piece of metal. The mouthpiece 20 is received in the mouthpiece receiver 22. The leadpipe 26 comprises a fiction means 24, 25 and for removably retaining and adjusting the pitch of the instrument. In a preferred embodiment the friction means 24 comprises a split collar 25 surrounding the end of the lead pipe 26 that is tightened or loosened by turning a thumbscrew 27. When the mouthpiece 20 is in the mouthpiece retainer 22, the retention means 24 operates to retain the position of the leadpipe at the properly tuned position. The mouthpiece 20 comprises a generally negative conical shape and has an exit bore 28 substantially equal to the entrance 31 of the positively conical lead pipe 26.

Inasmuch as the preceding disclosure presents the best mode devised by the inventor for practicing the invention and is intended to enable one skilled in the pertinent art to carry it out, it is apparent that methods incorporating modifications and variations will be obvious to those skilled in the art. As such, it should not be construed to be limited thereby but should include such aforementioned obvious variations and be limited only by the spirit and scope of the following claims.

I claim:

1. A brass-wind instrument comprising:

a mouthpiece;

a lead pipe in fluid communication with said mouthpiece;

a monoblock valve body in fluid communication with said lead pipe further comprising a plurality of valve chambers;

a plurality of valves dispersed in said valve chambers;

a plurality of elongation tubes in fluid communication with said monoblock valve body to elongate an air column therein;

an exit tube; and a bell in fluid communication with said exit tube.

2. The brass-wind instrument of claim 1 wherein each valve comprises an unimpeded air channel.

3. The brass-wind instrument of claim 1, wherein each elongation tube interfaces with said monobody valve block at an angle substantially perpendicular to the axis of said valve chamber.

4. The brass-wind instrument of claim 1 wherein said mouthpiece receiver is gapless.

5. The brass-wind instrument of claim 4, wherein said gapless mouthpiece comprises a negatively shaped conical shank.

6. The brass-wind instrument of claim 5, wherein said negatively shaped conical shank comprises an inner diameter equal to the inner diameter of the entrance to said leadpipe.

7. The brass-wind instrument of claim 6, wherein said leadpipe has a positive conical shape.

8. The brass-wind instrument of claim 1, wherein the valve channel in said monobody valve block further comprises valve guides.

9. The brass-wind instrument of claim 1, wherein said monobody valve block comprises a threaded region at the top of each valve cylinder to complimentarily receive a valve cap.

10. The brass-wind instrument of claim 1, wherein said monobody valve block comprises a threaded region at the bottom of each valve cylinder to complementarily receive a cap to manage lubricant run-off from the valve.

11. A monoblock valve body for a musical instrument comprising: a single piece body further comprising a plurality of valve cylinders for receiving valves and a plurality of ports and interfaces in fluid communication with said valve cylinder, wherein said ports and interfaces are substantially perpendicular to the axis of said valve cylinder and wherein at least one valve casing further comprises a threaded region at the top portion of said valve casing to retain a valve piston.

12. The monoblock valve body of claim 11, wherein said ports are in further fluid communication with tubes.

13. The monoblock valve body of claim 12, wherein said tubes comprise a lead pipe, a plurality of elongation tubes, and an exit tube.

14. The monoblock valve body of claim 11, wherein said interfaces provide fluid communication between valves.

15. The monoblock valve body of claim 11, wherein said valves are unimpeded.

16. The monoblock valve body of claim 11, wherein said valves further comprise valve guides.

17. The monoblock valve body of claim 11, wherein said valve body is manufactured from brass.

18. The monoblock valve body of claim 11, wherein at least one valve casing further comprises a threaded region at the top portion of said valve casing to receive a valve cover.

* * * * *